United States Patent [19]

Abe et al.

[11] 4,441,324

[45] Apr. 10, 1984

[54] THERMAL SHIELD STRUCTURE WITH CERAMIC WALL SURFACE EXPOSED TO HIGH TEMPERATURE

[75] Inventors: Toshio Abe, Komae; Hiroshi Ishikawa, Zama; Shigeo Suhara, Hachioji, all of Japan

[73] Assignee: Kogyo Gijutsuin, Tokyo, Japan

[21] Appl. No.: 242,606

[22] Filed: Mar. 11, 1981

[30] Foreign Application Priority Data

Apr. 2, 1980 [JP] Japan ..... 55-42018

[51] Int. Cl.[3] ..... F02G 1/00

[52] U.S. Cl. ..... 60/753

[58] Field of Search ..... 60/752, 753; 431/351, 431/352, 353

[56] References Cited

U.S. PATENT DOCUMENTS

| | | | |
|---|---|---|---|
| 2,548,485 | 4/1951 | Lubbock | 60/753 |
| 2,686,655 | 8/1954 | Schorner | 60/753 |
| 2,915,877 | 12/1959 | Darling | 60/753 |
| 2,919,549 | 1/1960 | Haworth et al. | 60/753 |
| 3,956,886 | 5/1976 | Sedgwick | 60/753 |

*Primary Examiner*—Carlton R. Croyle
*Assistant Examiner*—Jeffrey A. Simenauer
*Attorney, Agent, or Firm*—Robert E. Burns; Emmanuel J. Lobato; Bruce L. Adams

[57] ABSTRACT

A thermal shield structure with ceramic blocks for protecting high-temperature-exposed wall surface in which wedge-shaped supporting members and wedge-shaped members to be supported, respectively provided on the wall surface and ceramics blocks as a plurality of pairs of wedge-groove couplings, are engaged with each other to cover the wall surface with the ceramic blocks. In accordance with the invention, a gap small enough to prevent mutual disengagement of each pair of the wedge-shaped supporting member and the wedge-shaped supported member is provided therebetween to permit movement of the ceramic blocks towards the wall surface. A passage for an air supply into each wedge-shaped supporting member is provided so that each wedge-shaped supported member is urged by the pressure of supplied air to be retained in the wedge-shaped supporting member, whereby the ceramic blocks are held on the wall surface.

3 Claims, 8 Drawing Figures

THERMAL SHIELD STRUCTURE WITH CERAMIC WALL SURFACE EXPOSED TO HIGH TEMPERATURE

BACKGROUND OF THE INVENTION

The present invention relates to a thermal shield structure with ceramics for wall surfaces which are exposed to high temperatures, and more particularly to an arrangement for supporting ceramic blocks to such wall surfaces.

In a device having a wall surface which is exposed to high temperatures, for example, in a liner of a combustor of a gas turbine, for protecting the wall surface from high temperatures to retain its mechanical strength, it has been proposed to cover the wall surface of the liner with ceramic blocks. For mounting the ceramic blocks, it is general practice to form wedge-shaped support grooves on the wall surface of the liner in its axial direction and fit in the grooves wedge-shaped support projections provided on the ceramic blocks. In practice, however, it often happens that some of the wedge-shaped support projections cannot be fitted into the grooves and, even if fitted into the grooves, there exist large amounts of play. Accordingly, it is necessary to select from a number of ceramic blocks those which can be fitted into the grooves with a small amount of play; therefore, assembling of the ceramic blocks is very cumbersome. Further, since the thermal expansion coefficients of the metal forming the liner and the ceramic blocks are different, even if the support projections of the ceramic blocks are snugly fitted into the support grooves, it is very likely that during heating, play is introduced in the assembly by the thermal expansion of the liner which is larger than the thermal expansion of the ceramics.

SUMMARY OF THE INVENTION

An object of the present invention is to provide a ceramic block mounting structure which is free from the abovesaid defects of the complexity in the mounting of the ceramic blocks on the liner and the occurrence of play in the assembly due to thermal expansion.

In accordance with the present invention, there is provided a thermal shield structure with ceramics for a high-temperature-exposed wall surface in which wedge-shaped supporting members and wedge-shaped members to be supported, respectively provided on the wall surface and ceramics blocks as a plurality of pairs of wedge-groove couplings, are engaged with each other to cover the wall surface with the ceramic blocks. A gap small enough to prevent mutual disengagement of each pair of said wedge-shaped supporting member and said wedge-shaped supported member is provided therebetween to permit movement of the ceramic blocks towards the wall surface, and a passage for an air supply into each wedge-shaped supporting member is provided so that each wedge-shaped supported member is urged by the pressure of supplied air to be retained in the wedge-shaped supporting member, whereby the ceramic blocks are held on the wall surface.

BRIEF DESCRIPTION OF THE DRAWING

The present invention will be described in detail below in comparison with prior art with reference to the accompanying drawings, in which.

DETAILED DESCRIPTION OF THE INVENTION

To make the differences between the present invention and the prior art clear, an example of the prior art will first be described with reference to FIGS. 1 and 2.

Figure 1:
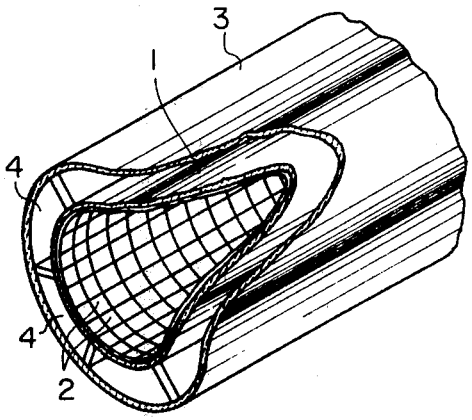
Fig. 1 PRIOR ART
FIGS. 1 and 2 are partial perspective views showing a prior art example of the protection of a liner wall surface of a gas turbine from high temperatures, using ceramics.
Figure 2:
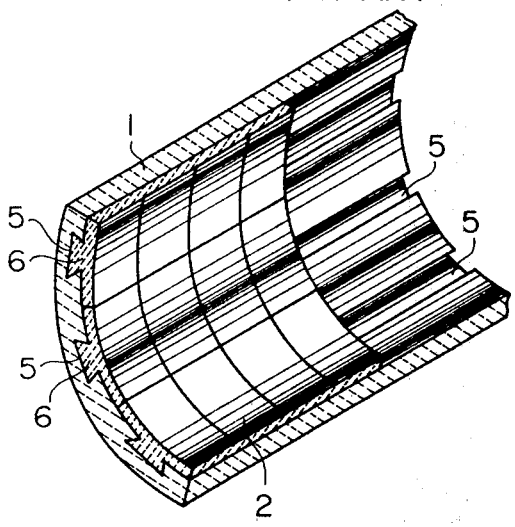
Fig. 2 PRIOR ART

In a device having a wall surface which is exposed to high temperatures, for example, in a liner of a combustor of a gas turbine, for protecting the wall surface from high temperatures to retain its mechanical strength, it has been proposed to cover the wall surface of the liner 1 with ceramic blocks 2 as shown in a partial perspective view of FIG. 1. In FIG. 1, reference numeral 3 indicates a cylinder and 4 designates cooling air passages. For mounting the ceramic blocks, it is general practice to form wedge-shaped support grooves 5 in the wall surface of the liner 1 in its axial direction and fit in the grooves wedge-shaped support projections 6 provided in the ceramic blocks 2 (for example, of sintered zirconium) as shown in a partial enlarged perspective view of FIG. 2. In this case, it is necessary to mount the ceramic blocks 2 on the wall surface of the inner wall with a minimum of play and, to this end, the dimensional tolerances of the ceramic blocks 2 including the support projections 6 and the wedge-shaped grooves 5 of the liner must be tightly restricted. In practice, however, since it is difficult to satisfy such requirements, it often happens that some of the wedge-shaped support projections 6 cannot be fitted into the grooves and, even if fitted into the grooves, there exist large amounts of play. Accordingly, the above example of prior art has the abovementioned disadvantages.

Figure 3:
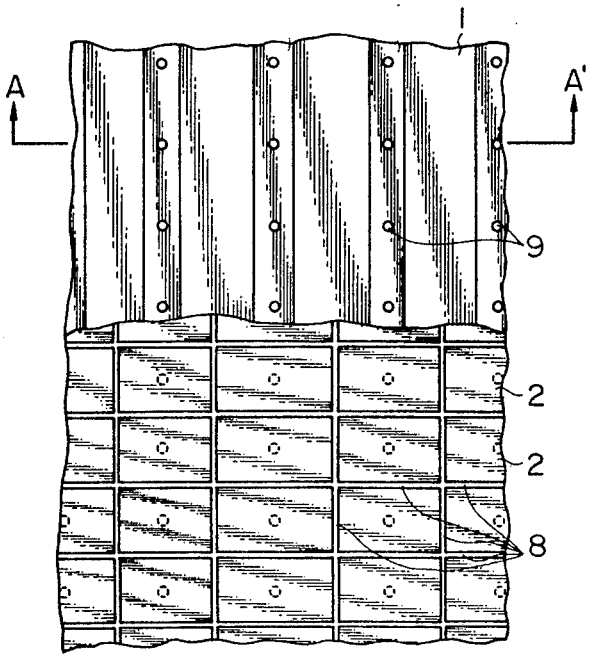
FIGS. 3, 4 and 5 are perspective views illustrating an embodiment of the present invention, FIG. 3 being a partial view of the inner wall surface with some ceramic blocks removed, FIG. 4 an enlarged sectional view taken on the line A—A′ in FIG. 3 and FIG. 5 an enlarged sectional view taken on the line A—A′ while in operation.
Figure 4:
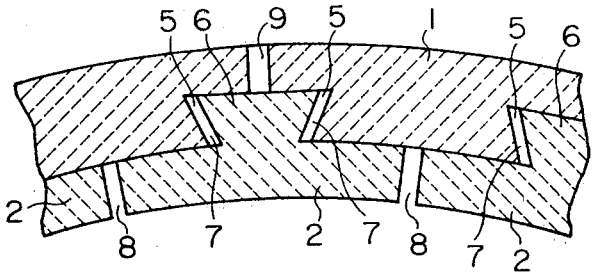
Figure 5:
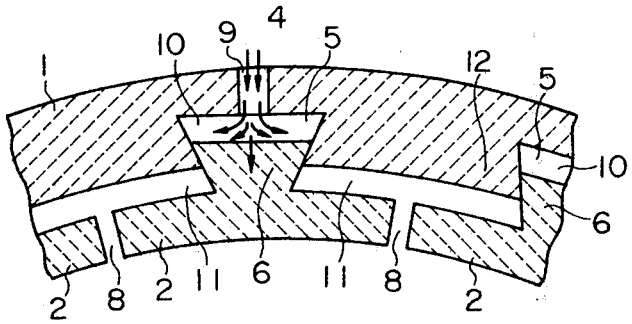

The present invention will hereinafter be described in detail. FIGS. 3, 4 and 5 are a partial plan view of the wall surface of a liner of a combustor of a gas turbine with some ceramic blocks removed, a partial enlarged sectional view taken on the line A—A′ in FIG. 3 and a similar partial enlarged sectional view on the line A—A′ during operation, illustrating an embodiment of the present invention. The same reference numerals as those in FIG. 1 indicate the same parts. In FIG. 3, reference numeral 1 indicates a liner and 2 designates ceramic blocks, which are mounted on the inner wall 1 by fitting their wedge-shaped support projections 6 into the wedge-shaped support grooves 5 formed in the wall surface of the liner as in the prior art. In the present invention, however, special arrangements such as described below are employed for supporting the ceramic blocks to facilitate the assembling thereof.

Firstly, the wedge-shaped support projection 6 is made smaller in size than the wedge-shaped support groove 5 so that when they are assembled together, there is provided therebetween a gap 7 small enough to prevent the wedge-shaped support projection 6 from falling out of the groove, as shown in FIG. 4, and the size of each of the ceramic blocks 2 is selected so that when assembled together, they are spaced apart from adjacent blocks, as indicated by 8 in FIGS. 3 and 4. With such an arrangement, the bottom of the wedge-shaped support projection 6 is pressed in the radial direction of the liner 1, by which left and right wall surfaces of the support projection 6 are urged against left and right side surfaces of the innerwall of the groove 5 in a manner to be retained therein, as shown in FIG. 5. Secondly, one or more cooling air supply paths 9 through which the cooling air passage 4 mentioned previously in connection with FIG. 1 and the wedge-shaped support groove 5 intercommunicate with each other are formed in the liner 1 to extend therethrough in the vicinity of the center of each ceramic block 2, as shown in FIGS. 3 and 4. Cooling air is supplied via each supply path to the wedge-shaped support groove 5 to apply a pressure to the bottom of the wedge-shaped support projection 6 in a direction indicated by the arrow in FIG. 5.

By providing such a gap 5 between the wedge-shaped support groove 5 and the support projection 6 so that the latter is urged by the pressure of the cooling air against the inner side walls of the support groove 5, assembling of the ceramic blocks with the liner is made extremely easy and since no dimensional tolerances are required, the manufacturing cost is reduced. Further, even if the wedge-shaped support groove 5 becomes large due to thermal expansion, the ceramic block 2 is pressed by the pressure of the cooling air to urge its side walls against the side walls of the groove 5, thus ensuring prevention of disengagement of the block from the groove. Moreover, in accordance with the present invention, when the ceramic block 2 is pressed by the cooling air, an air gap 10 is automatically formed between the bottoms of the wedge-shaped support projection 6 and the support groove 5, and air gaps 11 are also formed between the wall surface of the liner 1, in which the support groove 5 is not formed, and the back of the ceramic block 2. Accordingly, the thermal shielding action is provided not only by the ceramic blocks 2 but also by the air gaps 10 and 11, so that the protection of the wall surface of the liner from high temperatures can be greatly promoted and, further, the air gap 10 serves as a pneumatic spring to alleviate any shock which is applied to the ceramic block.

Figure 6:
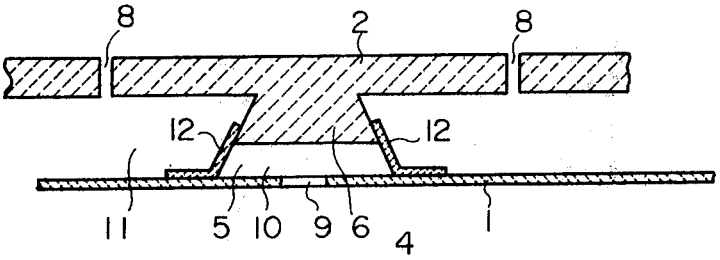
FIGS. 6, 7 and 8 are partial enlarged sectional views showing modified forms of the present invention.
Figure 7:
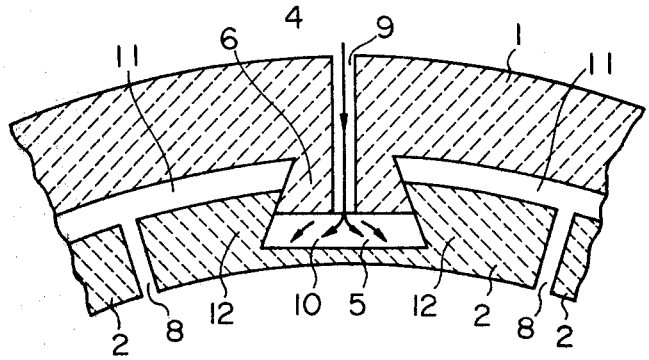
Figure 8:
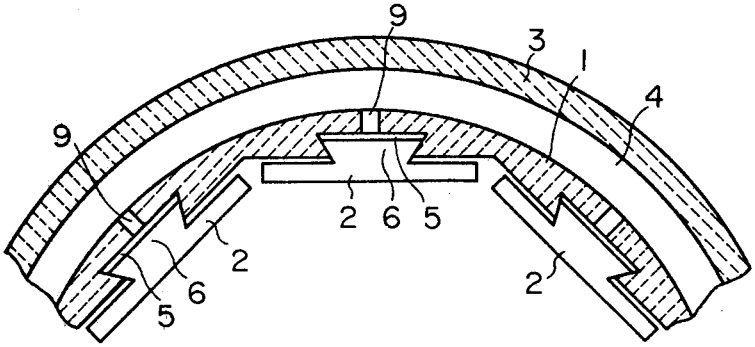

While in the foregoing the wedge-shaped support grooves 5 are formed by cutting the wall surface of the liner, it is also possible that tow pieces 12, each having an L-shaped cross-section, are fixed to the wall surface of the liner in a manner to form a wedge-shaped member, as shown in a partial enlarged sectional view of FIG. 6. Further, in the above the wedge-shaped support groove 5 is provided on the liner 1 and the wedge-shaped support peojection 6 on the ceramic block 2, but it is also possible to reverse the positions of their installation as shown in FIG. 7. Moreover, in the above the ceramic block 2 is made to conform to the curved wall surface of the liner 1 but it is also possible to make the wall surface of the liner 1 polygonal to form flat wall surfaces for the provision thereon of the ceramic blocks 2 of a flat-plate-like configuration as shown in FIG. 8.

Still further, the present invention is described as being applied to the liner of a combustor of a gas turbine, but the present invention produces an excellent effect when employed for protection of a blade of a gas turbine, high-temperature-exposed wall surfaces in an MHD generator, and so forth. In addition, the foregoing example employs cooling air for moving the ceramic blocks 2. However, in a device having no cooling air source or in a case where a cooling air source is provided but is difficult to use for such a purpose, the present invention can be practiced by providing an independent air source.

As will be appreciated from the foregoing, the present invention offers a thermal shield structure for a high-temperature-exposed wall surface which makes it far simpler and easier than in the prior art to assemble ceramic blocks for the protection of the wall surface from high temperatures. Accordingly, the present invention is of great practical utility.

What we claim is:

1. For use in a thermal shield structure having ceramic blocks for protecting a high-temperature exposed wall surface in which supporting members having a wedge-shaped groove and wedge-shaped members on said ceramic blocks to be supportedly received in said wedge-shaped groove, respectively provided on the wall surface wherein said supporting members and ceramic blocks, defining a plurality of pairs of wedge-groove couplings, are engaged with each other to cover the wall surface with said ceramic blocks, the improvement comprising: the wedge-shaped groove in each of said supporting members and each said wedge-shaped members to be supported thereby being dimensioned to define therebetween a gap in said wedge-shaped groove small enough to prevent mutual disengagement of each pair of the wedge-shaped couplings of the supporting members and the wedge-shaped supported members and sufficient to permit movement of the ceramic blocks relative to the wall surface, and for each wedge-shaped supported member a passage for a cooling air supply from behind and into each wedge-shaped groove of each supporting member provided so that each wedge-shaped supported member is urged by the pressure of supplied cooling air so as to be retained and positioned in the wedge-shaped groove of the corresponding support member, whereby the corresponding ceramic blocks are moved to and held on the wall surface at a position defined by the individual wedge-shaped grooves on the supporting members and the corresponding wedge-shaped members to be supported in response to pressure from the cooling air introduced into each wedge-shaped groove of a supporting member.

2. A thermal shield structure according to claim 1, in which the size of each of said ceramic blocks is selected so that when said ceramic blocks are assembled to the wall surface, said ceramic blocks are spaced apart from adjacent ceramic blocks.

3. A thermal shield structure according to claim 1, in which the wall surface is polygonal.

* * * * *